US007681337B2

(12) United States Patent
Watson

(10) Patent No.: US 7,681,337 B2
(45) Date of Patent: Mar. 23, 2010

(54) PLOW WITH BLADE WING

(75) Inventor: Gary E. Watson, Mequon, WI (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 11/333,048

(22) Filed: Jan. 17, 2006

(65) Prior Publication Data

US 2007/0089325 A1 Apr. 26, 2007

Related U.S. Application Data

(63) Continuation-in-part of application No. 11/256,231, filed on Oct. 21, 2005.

(51) Int. Cl.
*E01H 5/06* (2006.01)

(52) U.S. Cl. ..... 37/281; 37/274

(58) Field of Classification Search ..... 56/231, 56/281, 273, 274, 280
See application file for complete search history.

(56) References Cited

U.S. PATENT DOCUMENTS

| | | | | | |
|---|---|---|---|---|---|
| 595,202 | A | | 12/1897 | Pearson et al. | |
| 1,927,078 | A | | 9/1933 | Weeks | |
| 2,218,512 | A | * | 10/1940 | Ball | 37/279 |
| 2,299,451 | A | | 10/1942 | Austin | |
| 2,410,543 | A | | 11/1946 | Kester | |
| 2,524,329 | A | | 10/1950 | Richardson | |
| 2,643,470 | A | | 8/1953 | Kaeser | |
| 3,157,099 | A | | 11/1964 | Ulrich | |
| 3,250,026 | A | | 5/1966 | Jocher et al. | |
| 3,302,317 | A | | 2/1967 | Domres | |
| 3,362,460 | A | * | 1/1968 | Ligh | 160/188 |
| 3,376,084 | A | | 4/1968 | Ulrich | |
| 3,425,497 | A | | 2/1969 | Strabala et al. | |
| 3,430,706 | A | | 3/1969 | Marron | |
| 3,477,151 | A | | 11/1969 | Zanella | |
| 3,657,828 | A | | 4/1972 | Anderson | 37/46 |
| 3,759,110 | A | * | 9/1973 | Davis | 74/99 R |
| 3,775,877 | A | | 12/1973 | Gova, Sr. | 37/42 |
| 3,803,733 | A | | 4/1974 | Ramsey | 37/44 |
| 3,807,064 | A | | 4/1974 | Schmidt, Jr. | 37/41 |
| 4,019,268 | A | | 4/1977 | Waterman | 37/10 |
| 4,073,077 | A | | 2/1978 | Essel et al. | 37/50 |
| 4,074,448 | A | | 2/1978 | Niemela | 37/41 |
| 4,099,578 | A | * | 7/1978 | Stevens | 172/815 |
| 4,145,825 | A | | 3/1979 | Bertolino | 37/42 |
| 4,196,532 | A | | 4/1980 | Muller | 37/105 |
| 4,249,323 | A | | 2/1981 | Mathis et al. | 37/42 |
| 4,275,514 | A | | 6/1981 | Maura | 37/42 |

(Continued)

OTHER PUBLICATIONS

Vennard et al, *Materials Moving Blade*, U.S. Patent Application Publication No. 2005/O097786 A1. published May 12, 2005.

(Continued)

*Primary Examiner*—Thomas B Will
*Assistant Examiner*—Mai T Nguyen
(74) *Attorney, Agent, or Firm*—Wood, Herron & Evans, LLP

(57) ABSTRACT

A plow assembly comprises a blade, structure attached to the blade and adapted to be attached to a vehicle for mounting the blade to and supporting the blade from the vehicle, and a wing attached to an end of the blade. The wing has a first portion mounted to the blade for translational movement relative thereto, and a second portion mounted to the first portion for rotational movement relative thereto. An actuator has a cylinder and first and second oppositely movable piston rods. The first piston rod and the cylinder operable to move the first portion of the wing relative to the blade, and the second piston rod and the cylinder are operable to move the second portion of the wing relative to the fist portion of the wing.

16 Claims, 16 Drawing Sheets

U.S. PATENT DOCUMENTS

Figure 1:
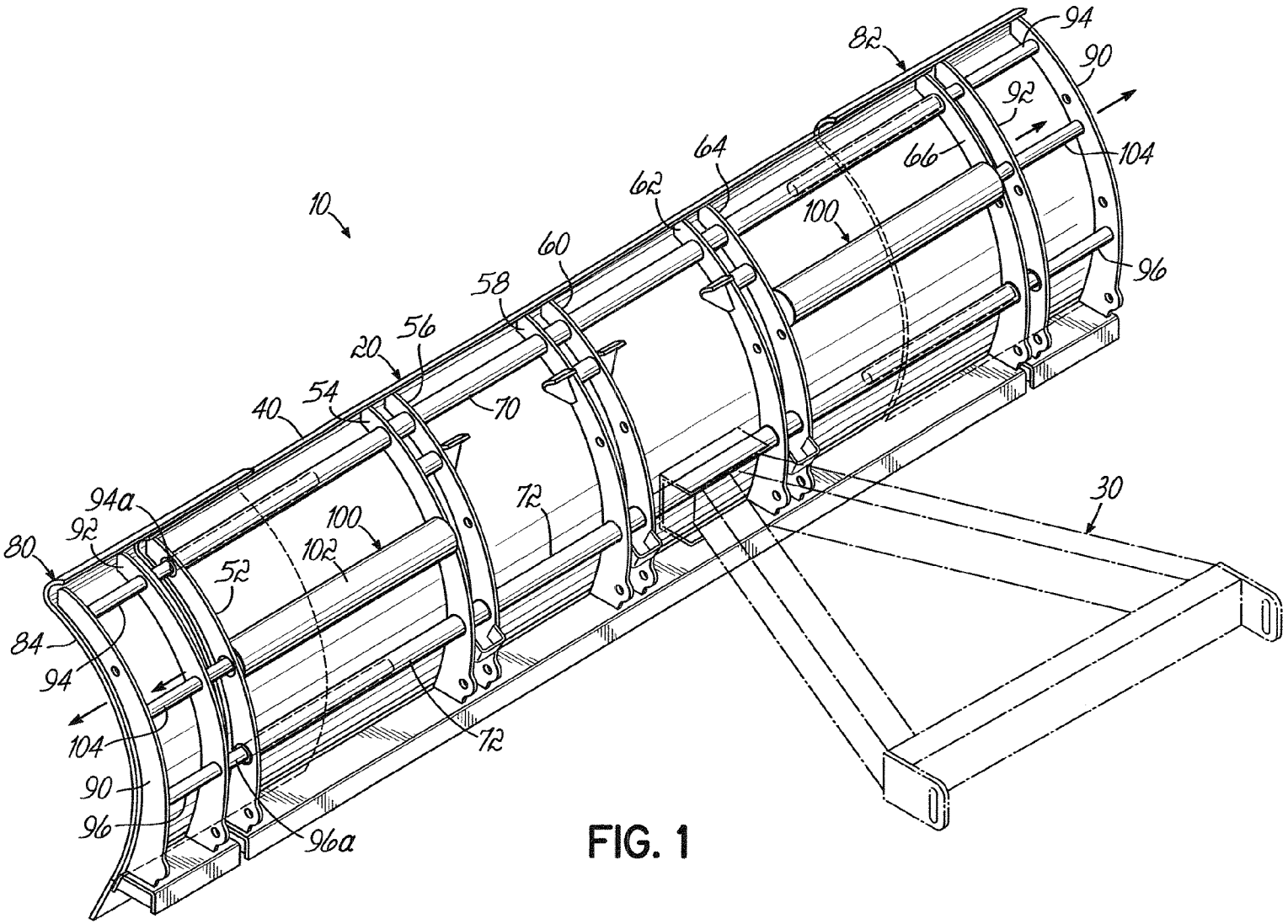

| | | | | |
|---|---|---|---|---|
| RE31,045 | E | 10/1982 | Essell et al. | 37/281 |
| 4,356,645 | A | 11/1982 | Hine et al. | 37/281 |
| 4,369,847 | A | 1/1983 | Mizunuma | 172/815 |
| 4,372,617 | A | 2/1983 | Zamboni | 299/24 |
| 4,479,312 | A | 10/1984 | Turgeon | 37/219 |
| 4,614,048 | A | 9/1986 | Melby | 37/280 |
| 4,658,519 | A | 4/1987 | Quenzi | 37/23 |
| 4,667,426 | A | 5/1987 | Howard et al. | 37/232 |
| 4,707,936 | A | 11/1987 | Steinhoff | 37/264 |
| 4,723,609 | A | 2/1988 | Curtis | 172/815 |
| 4,741,116 | A | 5/1988 | Engle et al. | 37/280 |
| 4,779,363 | A | 10/1988 | Boutrais et al. | 37/117.5 |
| 4,834,191 | A | 5/1989 | Vecchio | 172/784 |
| 4,962,600 | A | 10/1990 | Zellaha et al. | 37/280 |
| 5,165,191 | A | 11/1992 | Davis | 37/117.5 |
| 5,285,588 | A | 2/1994 | Niemela et al. | 37/234 |
| 5,375,349 | A | 12/1994 | Jochim | 37/429 |
| 5,392,538 | A | 2/1995 | Geerligs et al. | 37/268 |
| 5,411,102 | A | 5/1995 | Nickels et al. | 172/781 |
| 5,638,618 | A | 6/1997 | Niemela et al. | 37/281 |
| 5,655,318 | A | 8/1997 | Daniels | 37/231 |
| 5,819,444 | A | 10/1998 | Desmarais | 37/281 |
| 5,829,174 | A | 11/1998 | Hadler et al. | 37/234 |
| 5,848,654 | A * | 12/1998 | Belcher, Jr. | 172/815 |
| 5,860,230 | A | 1/1999 | Daniels | 37/232 |
| 5,894,689 | A | 4/1999 | Turk | 37/261 |
| 5,899,007 | A | 5/1999 | Niemela et al. | 37/261 |
| 5,921,326 | A * | 7/1999 | Ragule | 172/815 |
| 6,044,579 | A | 4/2000 | Hadler et al. | 37/234 |
| 6,167,977 | B1 * | 1/2001 | Adamson et al. | 180/69.2 |
| 6,240,660 | B1 | 6/2001 | Dugas | 37/280 |
| 6,408,549 | B1 | 6/2002 | Quenzi et al. | 37/281 |
| 6,412,199 | B1 | 7/2002 | Quenzi et al. | 37/281 |
| 6,442,877 | B1 | 9/2002 | Quenzi et al. | 37/281 |
| 6,463,683 | B1 | 10/2002 | Skwarchuk | 37/280 |
| 6,523,620 | B1 | 2/2003 | Burson | 172/815 |
| 6,681,505 | B1 | 1/2004 | Wells | 37/281 |
| 6,719,066 | B2 | 4/2004 | Haringer | 172/821 |
| 6,751,894 | B2 | 6/2004 | Verseef | 37/266 |
| 6,817,118 | B2 | 11/2004 | Schmeichel | 37/232 |
| 6,877,258 | B2 | 4/2005 | Frey | 37/281 |
| 7,134,227 | B2 * | 11/2006 | Quenzi et al. | 37/274 |

OTHER PUBLICATIONS

Fatemi, *Material Pusher With Improved Structure*, U.S. Patent Application Publication No. US 2005/O126051 A1, published 06/16/O5.

* cited by examiner

PLOW WITH BLADE WING

RELATED APPLICATIONS

This application is a continuation-in-part of application Ser. No. 11/256,231 filed Oct. 21, 2005, which is hereby incorporated by reference herein as if fully set forth in its entirety.

FIELD OF THE INVENTION

This invention relates generally to plows for moving any plowable material, and more particularly to vehicle mountable plows for moving snow and having one or more plow blade wings to aid the plow blade in moving the snow.

BACKGROUND OF THE INVENTION

A wide variety of plows for mounting on pickup trucks, sport utility vehicles ("SUV's"), "skid steers," and other vehicles for moving snow is in use. Among the plows in use are straight blade plows and center hinged blade V-plows.

Another type of plow in use employs rotating, translating, or rotating and translating wings mounted on the ends of the plow blade. Translating wings are useful for configuring the blade of the plow in a longer extended length for plowing, and in a shorter retracted length for over road travel. Rotating wings are useful for configuring the blade of the plow into "bucket" and/or "pusher" configurations. In the bucket configuration, the wings are angled forwardly relative to the plow blade, typically at an angle of about 30°. In the pusher configuration, the wings are angled forwardly relative to the plow blade at an angle of about 90°. In either case, the forwardly angled wings prevent snow from sliding off the ends of the blade during plowing. Of course, if desired, one or the other of the wings could be forwardly angled relative to the plow blade, rather than both, depending on the snow conditions, obstacles encountered during plowing, etc.

Examples of plows having wings which both rotate and translate are described in U.S. Pat. Nos. 6,442,877, 6,412,199, 6,408,549, 5,899,007, and 5,638,618, all assigned to Blizard Corporation, Calumet, Mich., and all hereby incorporated by reference herein. Each of these patents describes a plow having a slide mechanism and a hinge mechanism for adjustably mounting a wing to each end of the plow blade. Hydraulic cylinders are mounted to the snow plow blade for use in adjusting, i.e., rotating and translating, the plow wings.

The plows of U.S. Pat. Nos. 6,442,877, 6,412,199, 6,408,549, 5,899,007, and 5,638,618 are not without criticism. The slide mechanisms can be subject to galling from snow, ice, salt, and corrosion, and thus can suffer from premature wear. More powerful, and hence heavier, hydraulic cylinders can be required to actuate the slide mechanisms if corroded, frozen, etc. due to increased sliding frictional forces. The dual hydraulic cylinders which impart translating and rotating motion to the wings can add to the cost, complexity, and weight of the plow. The hinge mechanism can also be subject to galling from snow, ice, salt, and corrosion, and thus it too can suffer from premature wear. More powerful, and hence heavier, hydraulic cylinders can be required to actuate the hinge mechanisms if corroded, frozen, etc. due to increased torsional resistance.

It is desirable to improve upon current snow plows in use by providing a plow which is configurable to and between a longer extended length for plowing and a shorter retracted length for over road travel, and which is also configurable into bucket and/or pusher configurations, yet which does not suffer from the drawbacks of the plows of U.S. Pat. Nos. 6,442,877, 6,412,199, 6,408,549, 5,899,007, and 5,638,618.

SUMMARY OF THE INVENTION

In one aspect, the hinge mechanism and its associated adjusting hydraulic cylinder of the plows of U.S. Pat. Nos. 6,442,877, 6,412,199, 6,408,549, 5,899,007, and 5,638,618 is eliminated and the wing is fixedly mounted at an angle. In this aspect, the invention is a plow assembly comprising a blade, structure attached to the blade and adapted to be attached to a vehicle for mounting the blade to and supporting the blade from the vehicle, and a wing attached to an end of the blade. The wing has a first portion mounted for movement along the blade to and between a retracted position and an extended position, and a second portion mounted in fixed relation relative to the first portion at an angle relative thereto.

The first portion of the wing can be mounted for translational movement along the blade, for example, sliding movement along, for example, a forward side of the blade. The plow assembly can include an actuator for moving the first portion of the wing along the blade. The actuator can be a hydraulic cylinder. The second portion of the wing can be mountable in fixed relation relative to the first portion of the wing at at least two different angles relative thereto.

In another aspect, the invention is a plow assembly comprising a blade, structure attached to the blade and adapted to be attached to a vehicle for mounting the blade to and supporting the blade from the vehicle, and a wing attached to an end of the blade. The wing is selectably mountable in fixed relation relative to the blade at least two different angles relative thereto.

The wing can be mountable in fixed relation relative to the blade at angles of about 0° and about 30°, of about 0° and about 90°, of about 30° and about 90°, and/or of about 0°, about 30°, and about 90°.

In another aspect, the slide mechanism of the plows of U.S. Pat. Nos. 6,442,877, 6,412,199, 6,408,549, 5,899,007, and 5,638,618 is eliminated and the wing is mounted for rolling movement. In this aspect, a the invention is a plow assembly comprising a blade, structure attached to the blade and adapted to be attached to a vehicle for mounting the blade to and supporting the blade from the vehicle, and a wing attached to an end of the blade. The wing is mounted for rolling movement along the blade to and between a retracted position and an extended position. The wing can have a first and second portion, with the first portion mounted for rolling movement along the blade to and between a retracted position and an extended position, and the second portion mounted to the first portion at an angle relative thereto.

The first portion of the wing can be mounted for rolling movement along a forward side of the blade. The plow assembly can include an actuator for moving the first portion of the wing along the blade. The actuator can be a hydraulic cylinder. The second portion of the wing can be mounted in fixed relation relative to the first portion of the wing. The second portion of said wing can be mountable in fixed relation relative to the first portion of the wing at at least two different angles relative thereto. The second portion of the wing can be mounted for rotating movement relative to the first portion of the wing. The plow assembly can include an actuator for moving the second portion of the wing relative to the first portion of the wing. The actuator can be a hydraulic cylinder.

Blade assemblies for plow assemblies are also provided.

In yet another aspect, the invention is a plow assembly comprising a blade, structure attached to the blade and adapted to be attached to a vehicle for mounting the blade to and supporting the blade from the vehicle, and a wing attached to an end of the blade. The wing has a first portion mounted to the blade for translational movement relative thereto, and a second portion mounted to the first portion for rotational movement relative thereto. An actuator has a cylinder and first and second oppositely movable piston rods. The first piston rod and the cylinder operable to move the first portion of the wing relative to the blade, and the second piston rod and the cylinder are operable to move the second portion of the wing relative to the first portion of the wing.

The blade can be a straight blade, a single hinge V-blade, or a double hinge V-blade. The first portion of the wing can be mounted for rolling movement relative to the blade. To that end, the plow assembly can include a plurality of rollers mounted to the blade, or a plurality of rollers mounted to the first portion of the wing, to provide the relative rolling movement. Alternatively, the first portion of the wing can be mounted for sliding movement relative to the blade.

In yet another aspect, the invention is a plow assembly comprising a V-blade, structure attached to the V-blade and adapted to be attached to a vehicle for mounting the V-blade to and supporting the V-blade from the vehicle, and a wing attached to an end of the V-blade. The wing has a first portion mounted to the V-blade for translational movement relative thereto, and a second portion mounted to the first portion at an angle relative thereto.

The V-blade can be a single-hinge V-blade or a double hinge V-blade. The first portion of the wing can be mounted for rolling movement relative to the V-blade. To that end, the plow assembly can include a plurality of rollers mounted to the blade, or a plurality of rollers mounted to the first portion of the wing, to provide the relative rolling movement. Alternatively, the wing can be mounted for sliding movement relative to the V-blade. The second portion of the wing can be mounted to the first portion of the wing for rotational movement relative thereto. Alternatively, the second portion of the wing can be mounted to the first portion of the wing in fixed relation relative thereto. In the latter case, the second portion of the wing can be mountable in fixed relation relative to the first portion of the wing at at least two different angles relative thereto.

Blade assemblies for plow assemblies are also provided.

The plow of the invention can thus be lighter, simpler, less expensive, and less prone to wear than plows having complicated rotating and translating wings wherein the wing rotates on a hinge mechanism, the wing translates on a slide mechanism, and two hydraulic cylinders are used to adjust the rotation and translation of the wing.

These and other advantages of the present invention will become more readily apparent during the following detailed description taken in conjunction with the drawings herein, in which:

BRIEF DESCRIPTION OF THE DRAWINGS OF THE INVENTION

Figure 1A:
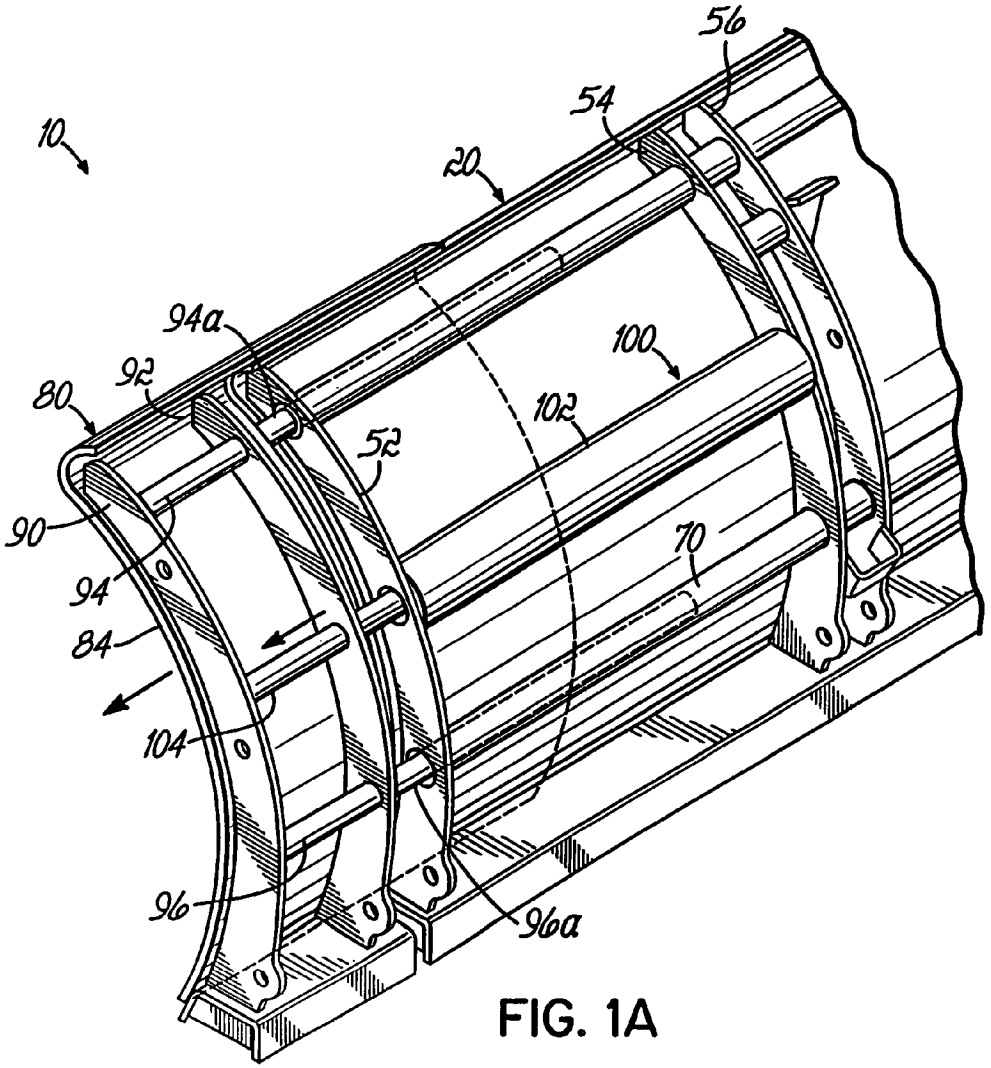
Figure 1B:
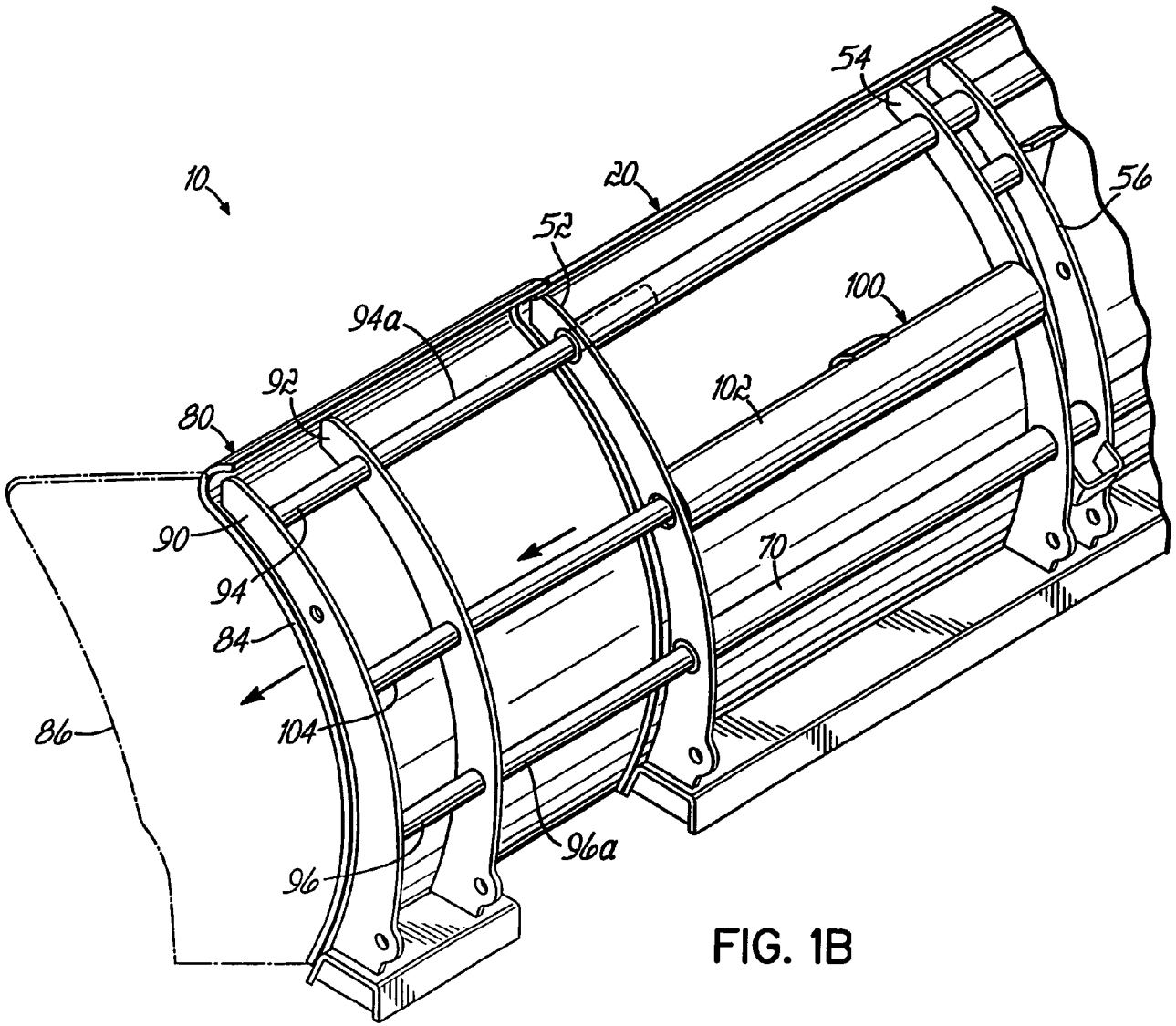

FIG. 1 is a rear perspective of a plow assembly according to the principles of the invention, FIG. 1A is an enlarged view of the left end of the blade assembly of the plow assembly of FIG. 1 illustrating the blade wing in the retracted position, FIG. 1B is a view similar to FIG. 1A illustrating a first portion of the blade wing in the extended position and a second portion of the blade wing mounted in fixed relation relative to said first portion at an angle relative thereto.

Figure 2A:
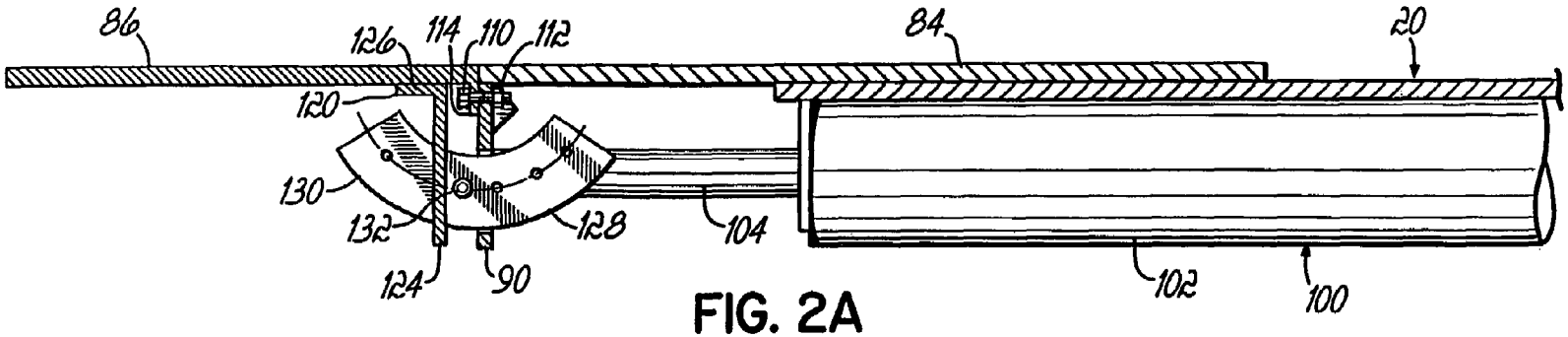
Figure 2B:
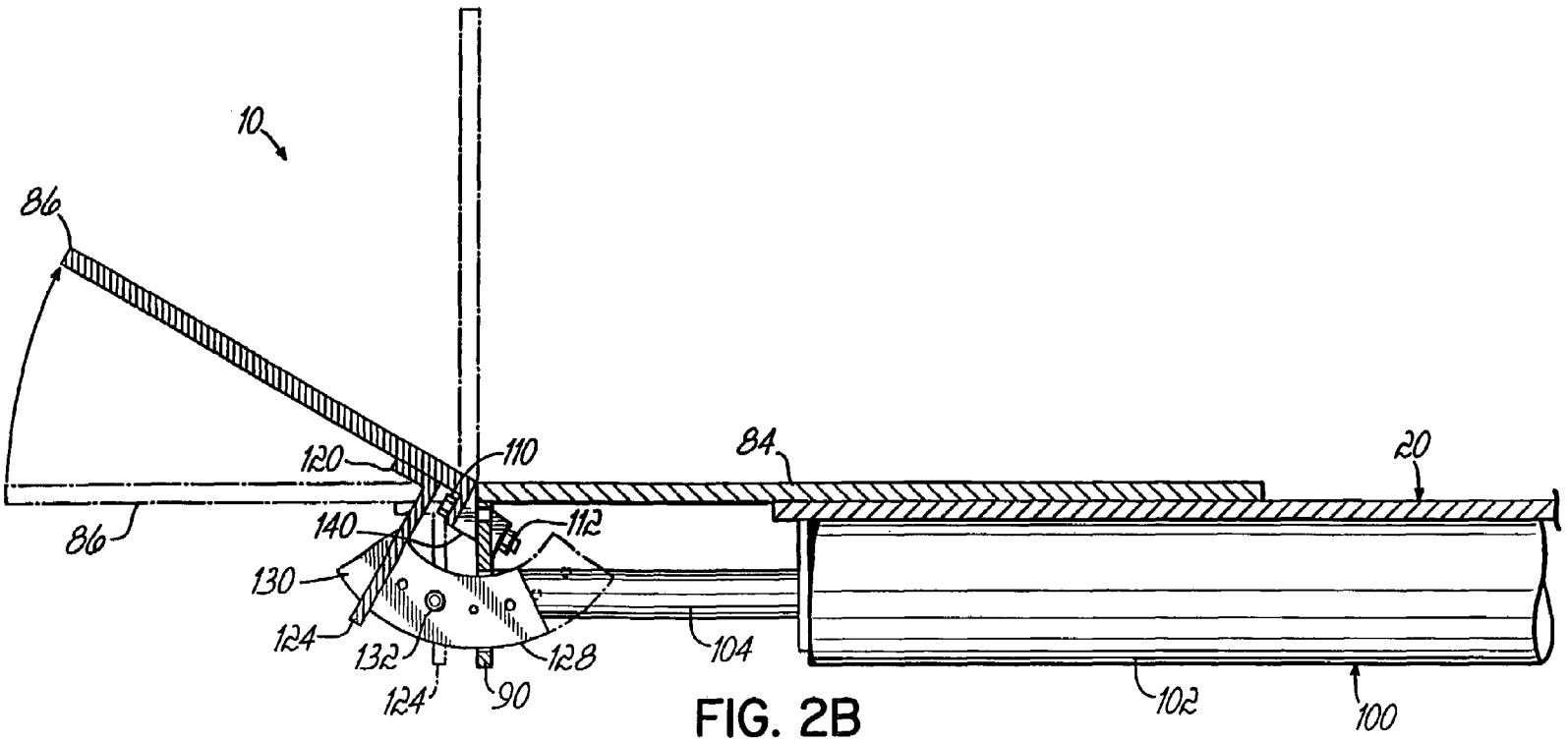
Figure 2C:
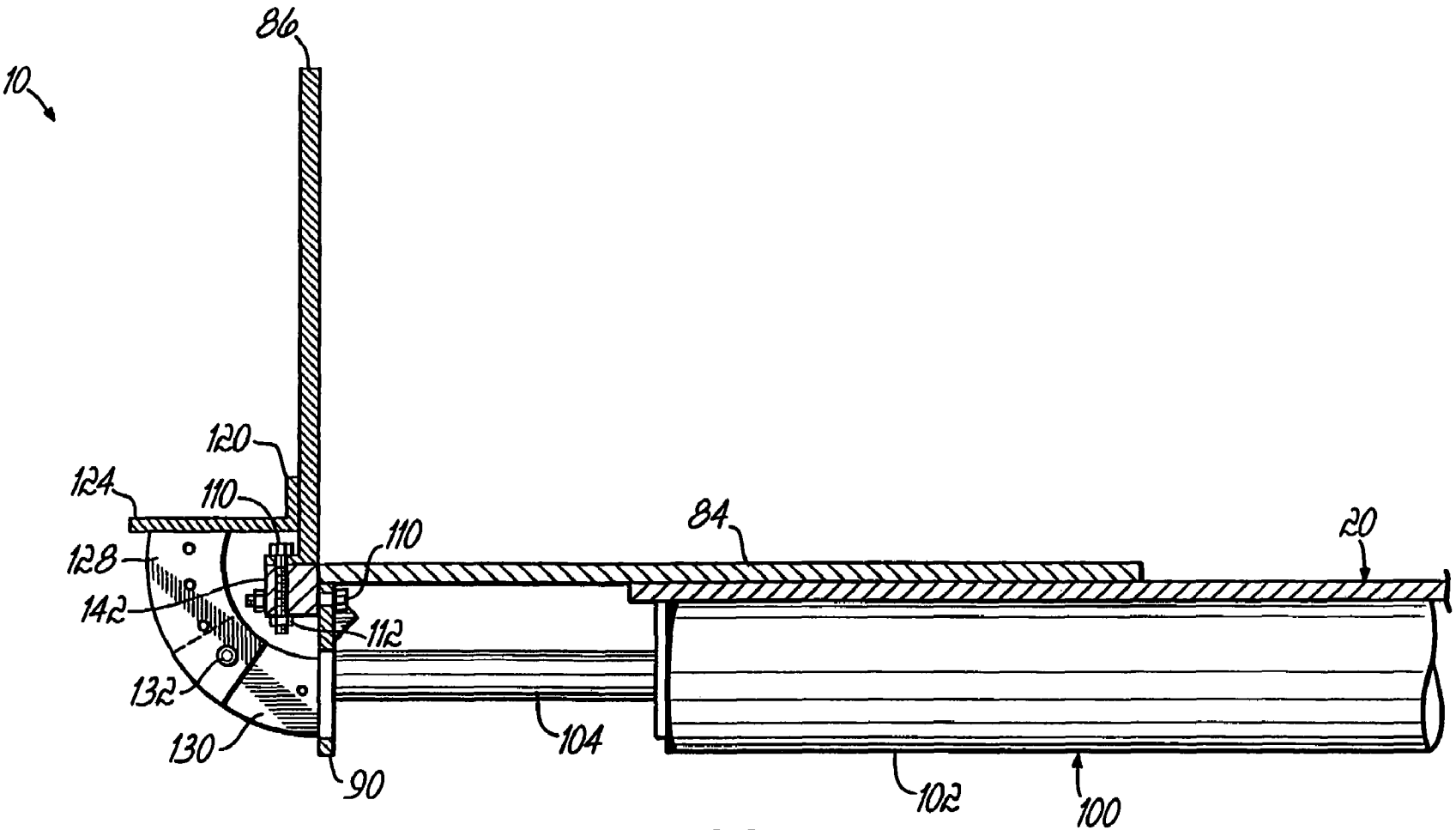
Figure 3:
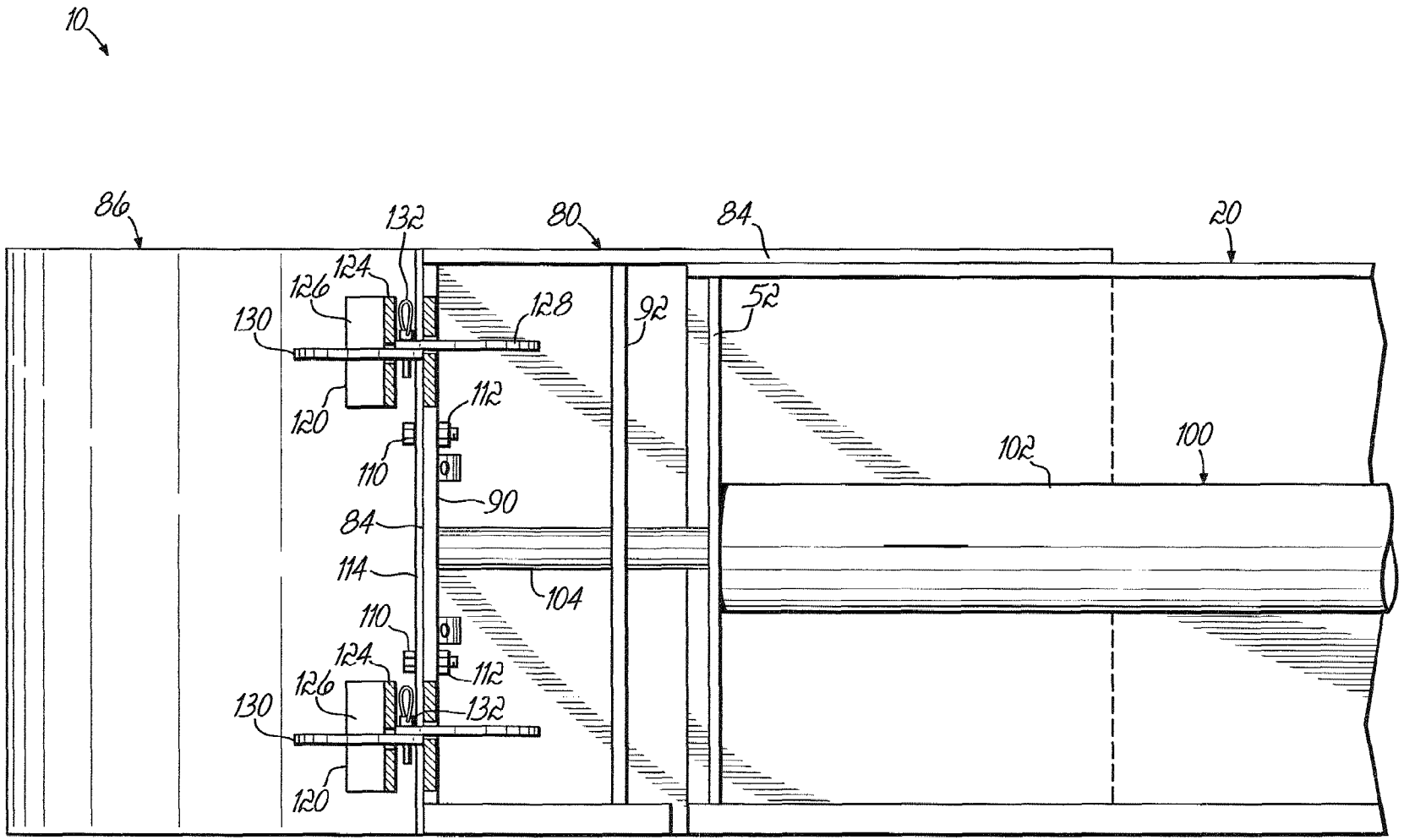
Figure 4:
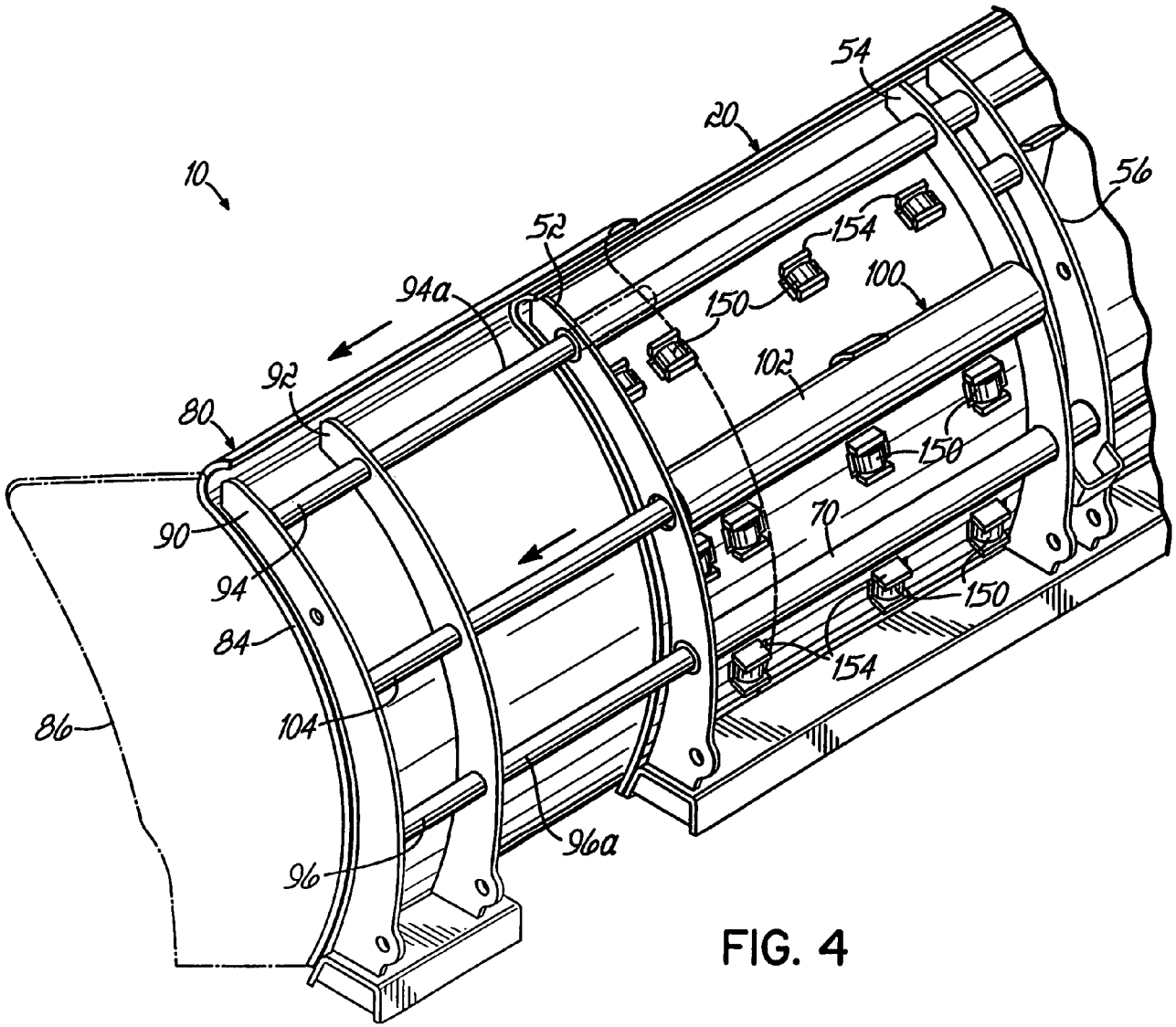
Figure 5:
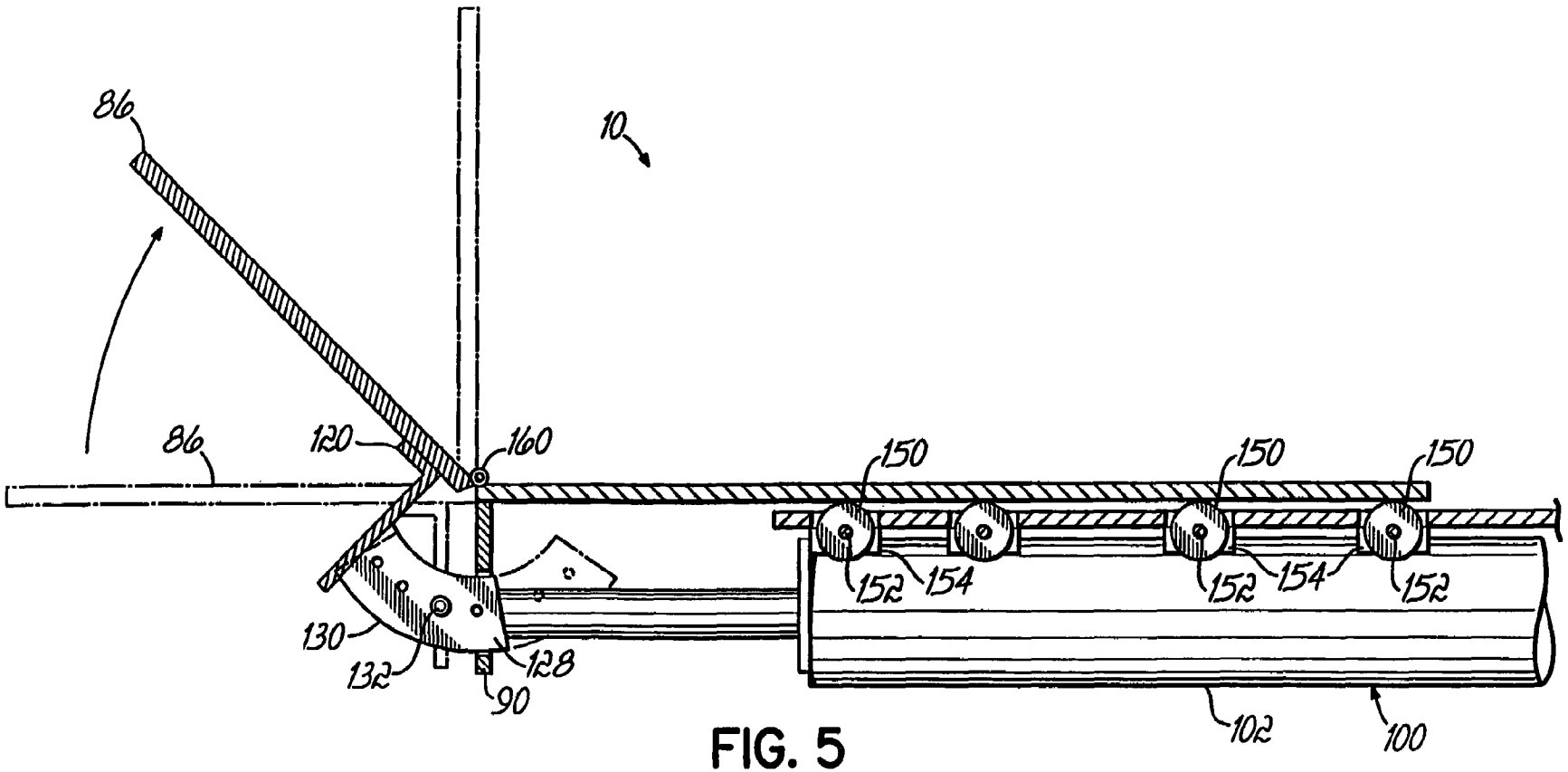
Figure 6:
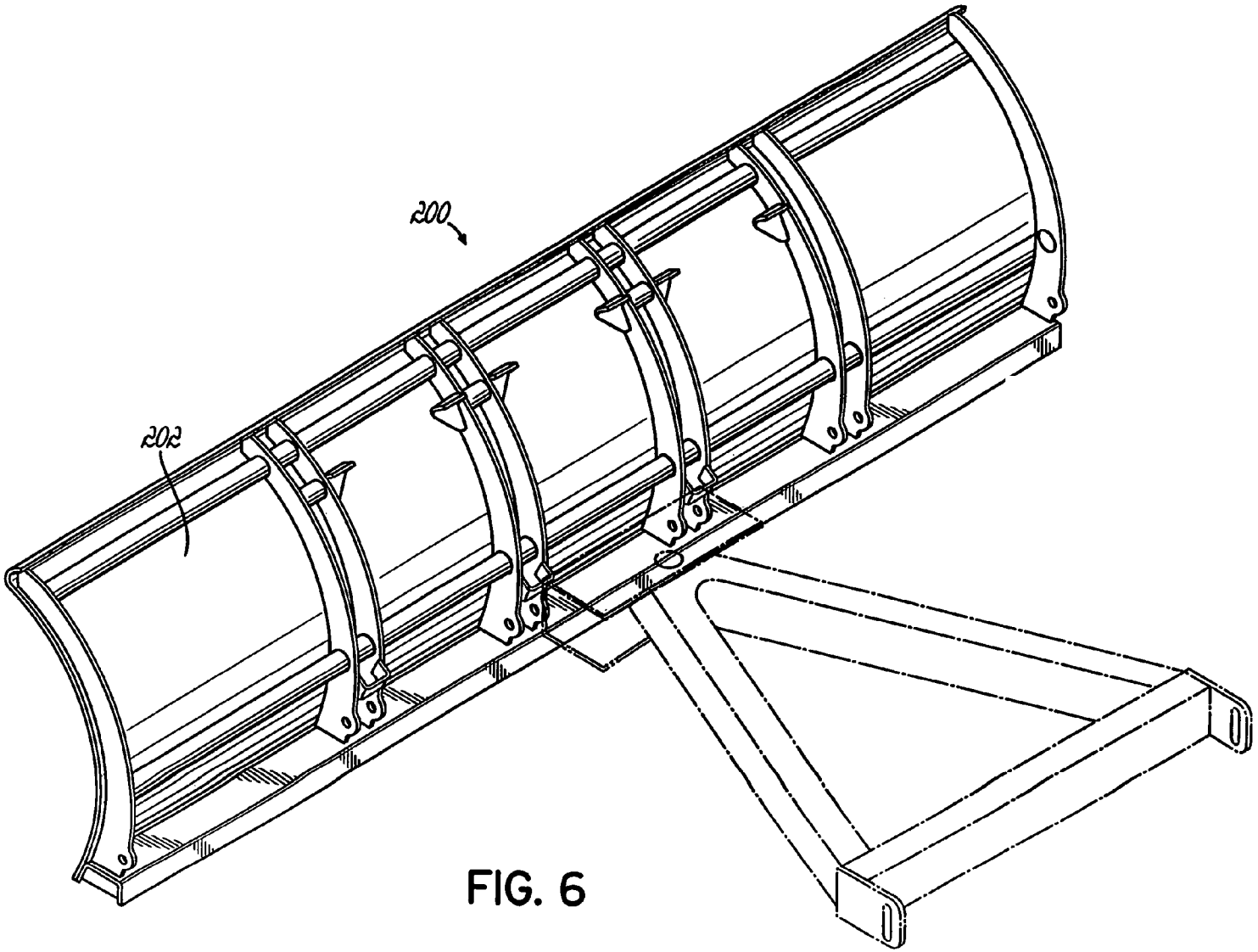
Figure 7:
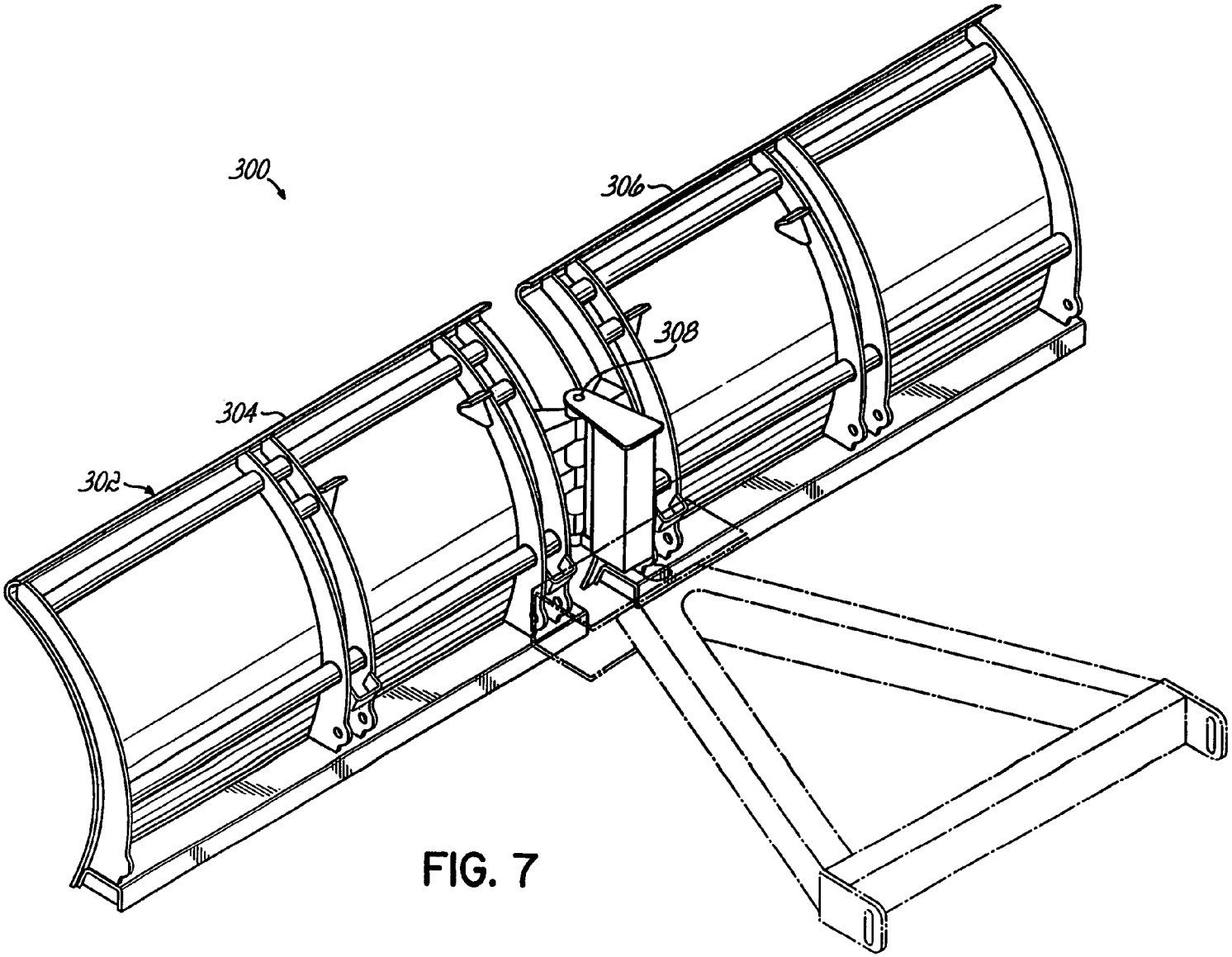
Figure 8:
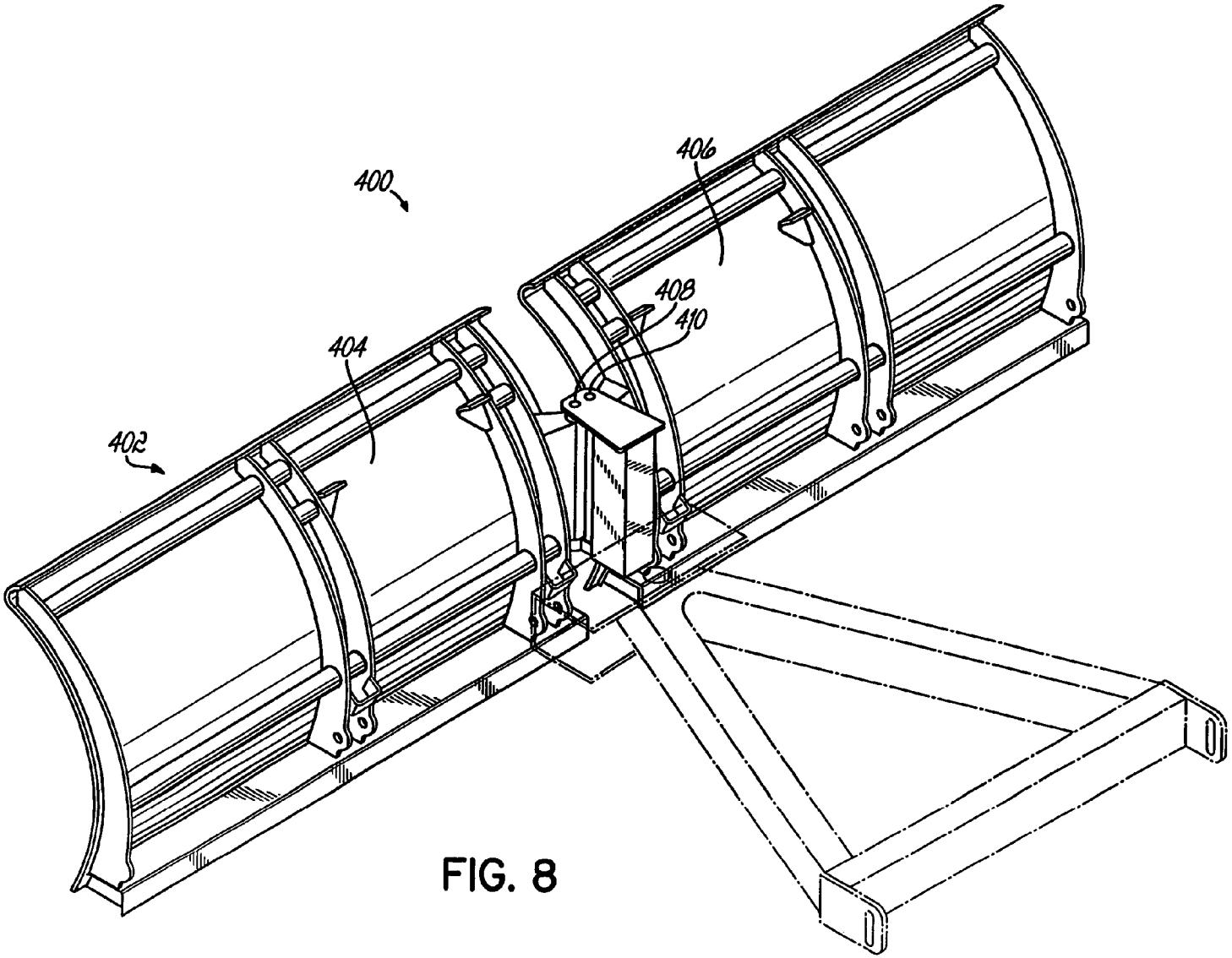
Figure 9:
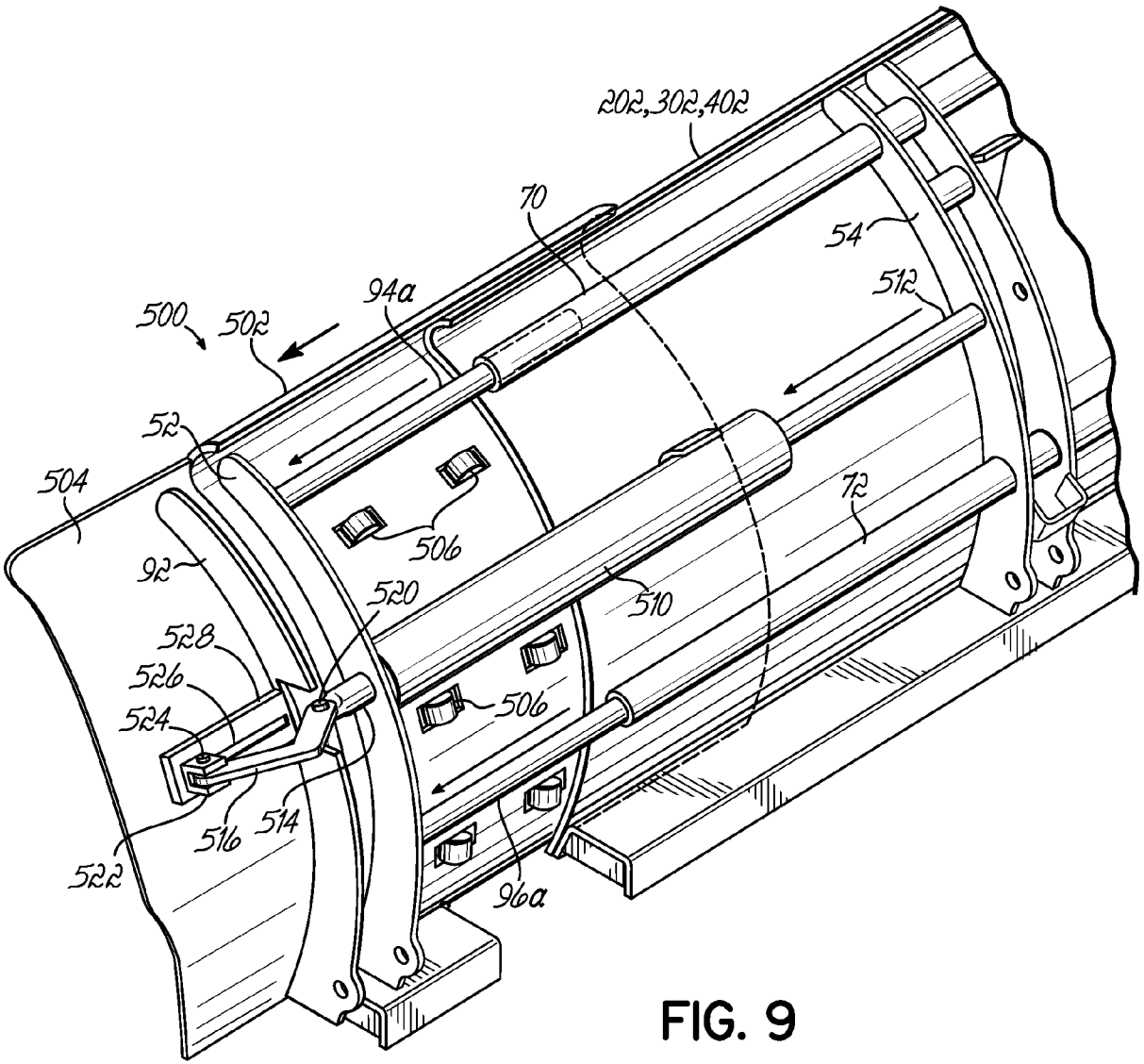
Figure 10A:
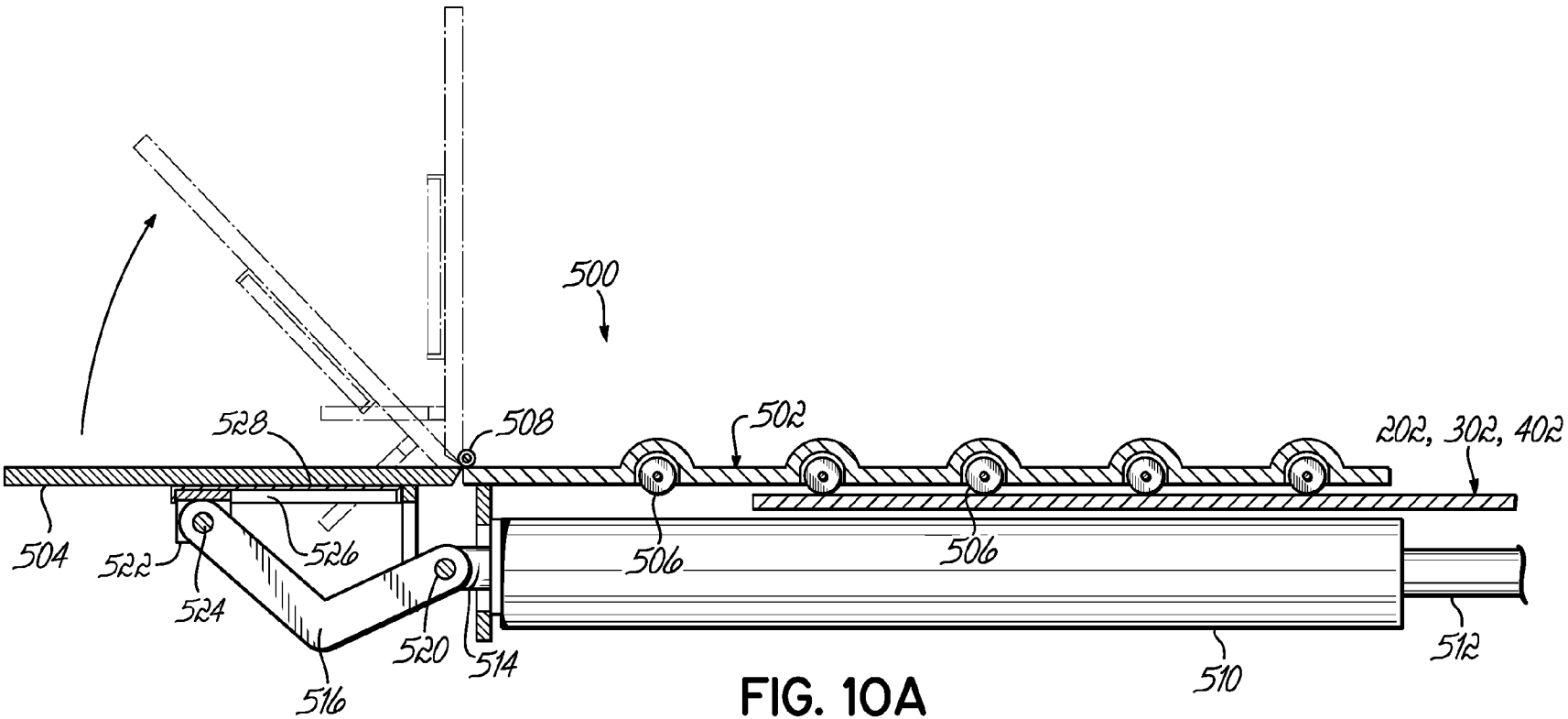
Figure 10B:
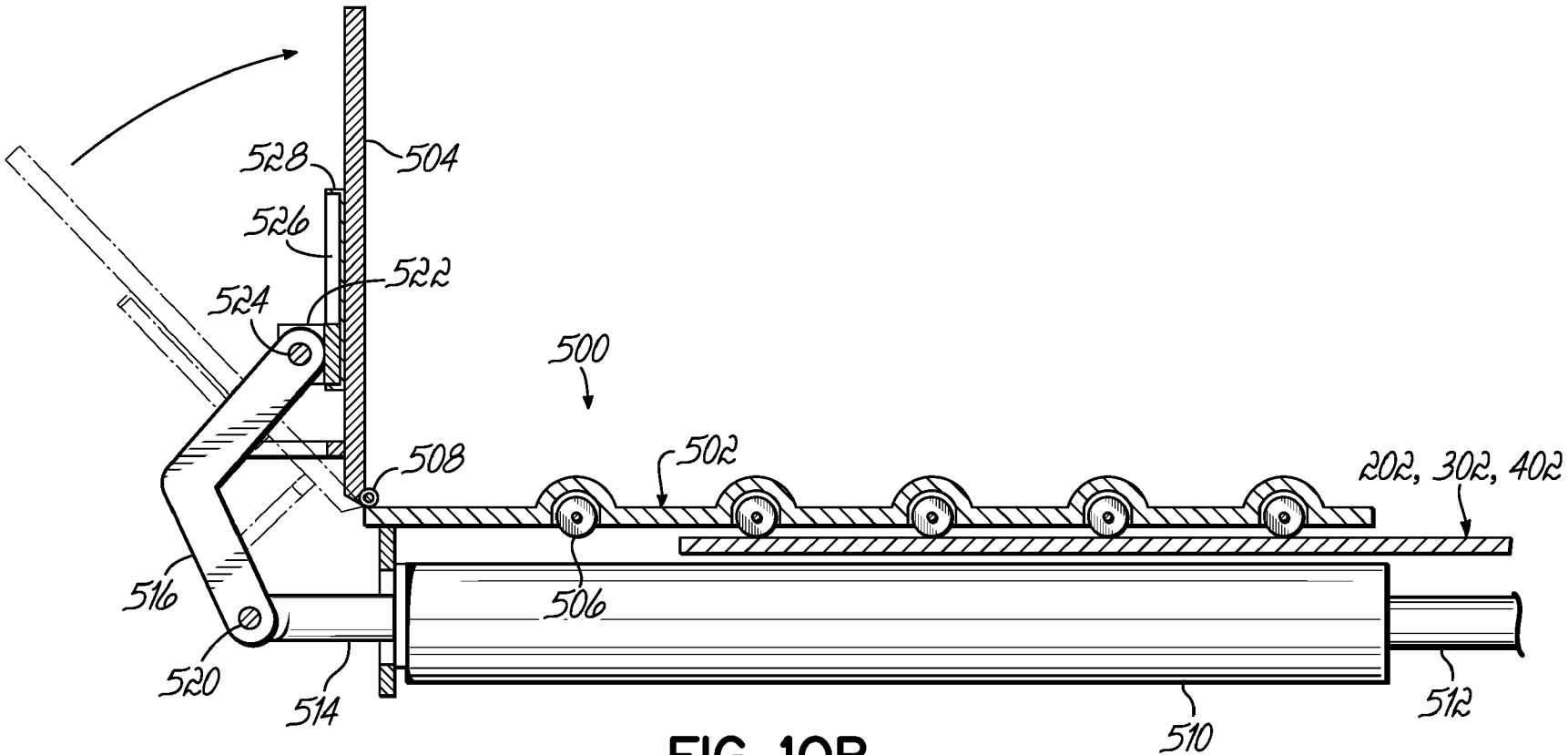
Figure 11:
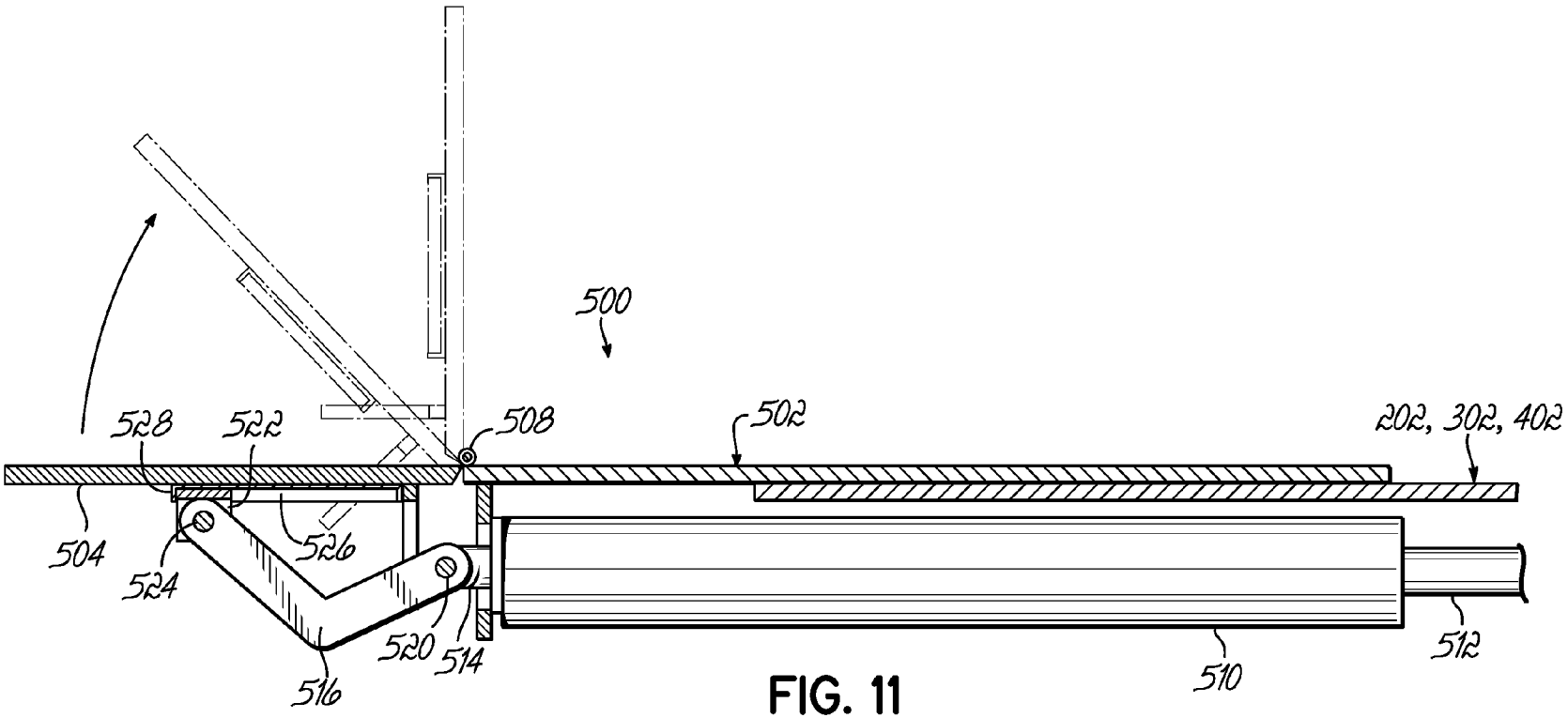
Figure 12:
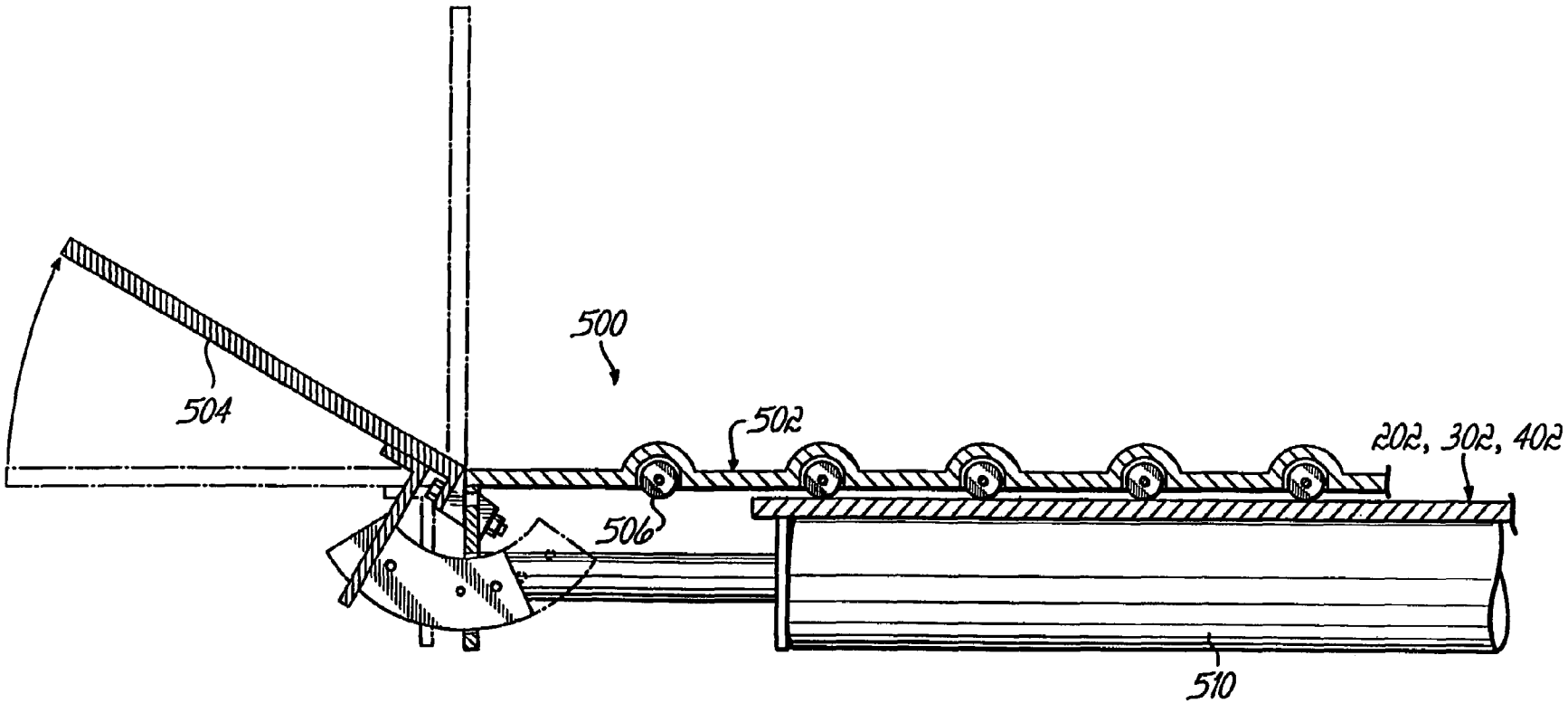

FIGS. 2A-C are top views of the left end of the blade assembly of FIGS. 1, 1A, and 1B illustrating the second portion of the blade wing mounted in fixed relation relative to the first portion at three different positions relative thereto, FIG. 3 is a rear view of the blade assembly of FIGS. 2A-C, FIG. 4 is a view similar to FIG. 1A but of an alternative embodiment of the invention, FIG. 5 is a top view similar to FIGS. 2A-C but of yet another alternative embodiment of the invention, FIG. 6 is a rear perspective view of a straight blade plow with which any of the blade wings can be used, FIG. 7 is a rear perspective view of a single hinge V-blade plow with which any of the blade wings can be used, FIG. 8 is a rear perspective view of a double hinge V-blade plow with which any of the blade wings can be used, FIG. 9 is an enlarged rear perspective view of the left end of the blade assembly of any of the plow assemblies of FIG. 6-8 illustrating still another alternative embodiment of the blade wing, FIG. 10A is a top view of the blade wing of FIG. 9 illustrating the first portion of the blade wing in the extended position and the second portion of the blade wing in a position aligned with the first portion (solid lines) and in a position angled forwardly relative to the first portion (phantom lines), FIG. 10B is a view similar to FIG. 10 but illustrating the second portion of the blade wing in the "scoop" forwardly angled position (phantom lines) and in the "bucket" forwardly angled position (solid lines), FIG. 11 is a view similar to FIG. 10A but illustrating the first portion of the blade wing being slidably mounted relative to the blade as opposed to being mounted for rolling movement, and FIG. 12 is a view similar to FIG. 11 but illustrating the second portion of the blade wing being mounted in fixed relation relative to the first portion at three different positions relative thereto.

DETAILED DESCRIPTION OF A PREFERRED EMBODIMENT OF THE INVENTION

Referring first to FIG. 1, there is illustrated a plow assembly 10 according to the principles of the invention. The plow assembly 10 includes a blade assembly 20 and structure 30 (shown in phantom) attached to the blade assembly 20 and adapted to be attached to a vehicle (not shown) for mounting the blade assembly 20 to and supporting the blade assembly 20 from the vehicle.

Blade assembly 20 includes a blade 40 which can have one or more stiffening ribs, for example stiffening ribs 52, 54, 56, 58, 60, 62, 64, and 66, along a rear side thereof. Blade 40 can also have one or more stiffening torque tubes, e.g., upper and lower torque tubes 70 and 72, respectively, along upper and lower edges, respectively, of the rear side of blade 40. Ribs 52, 54, 56, 58, 60, 62, 64, and 66 can be rigidly affixed to torque tubes 70 and 72 to increase the stiffness of the blade 40. At least one wing 80 is attached to at least one end of the blade 40. For example, a pair of wings can be attached to the opposite ends of blade 40, such as wing 80 attached to left hand end of blade 40 and wing 82 attached to right hand end of blade 40. Since the constructions of wings 80 and 82 are identical, only left hand wing 80 will be described in detail.

A first portion 84 of wing 80 is mounted for movement, for example, translational movement, sliding movement, etc., along the blade 40, for example along the forward side of the blade 40, to and between a retracted position (FIGS. 1 and 1A) and an extended position (FIG. 1B). A second portion 86 (shown in phantom in FIG. 1B) of wing 80 is mounted in fixed relation relative to the first portion 84 at an angle relative thereto. First portion 84 of wing 80 can include one or more stiffening ribs, for example stiffening ribs 90 and 92, along a rear side thereof. First portion 84 of wing 80 can also have one or more stiffening torque tubes, for example, upper and lower torque tubes 94 and 96, respectively, along upper and lower edges, respectively, of the rear side of first portion 84. Ribs 90 and 92 can be rigidly affixed to torque tubes 94 and 96 to increase the stiffness of the first portion 84. Torque tubes 94 and 96 can be of a smaller diameter than torque tubes 70 and 72 so that extensions thereof 94*a* and 96*a* thereof can telescope into and out of torque tubes 70 and 72, respectively.

An actuator, for example a hydraulic cylinder 100, can be included for moving the first portion 84 of the wing 80 along the blade 40. The cylinder portion 102 of hydraulic cylinder 100 can be mounted between ribs 52 and 54 of blade 40, whereas the rod portion 104 of the hydraulic cylinder 100 can be attached to rib 90 of first portion 84 of wing 80. Hydraulic cylinder 100 can be, for example, a Lion 2500 PSI Heavy Duty Tie Rod Hydraulic Cylinder, with a 2 inch bore and 16 inch stroke, Model #20TL16-112, available from Northern Tool and Equipment, Burnsville, Minn.

Referring now to FIGS. 1B, 2A-C, and 3, second portion 86 of wing 80 is illustrated. Second portion 86 is mounted in fixed relation relative to the first portion 84, albeit in three different positions.

As shown in FIG. 2A, second portion 86 is fixedly mounted to first portion 84 at about 0°. As an example, bolts 110 and nuts 112 can be used to secure flange 114 of second portion 86 to rib 90 of first portion 84 via a first set of bolt holes in flange 114 and rib 90. Additional reinforcement of second portion 86 to first portion 84 can be included. For example, upper and lower L-shaped brackets 120 can each have a leg 124 and a foot 126. Foot 126 can be attached to rear side of second portion 86. Leg 124 can have a plate 128 mounted thereto which extends laterally inwardly. Rib 90 can have a plate 130 mounted thereto which extends laterally outwardly below plate 128. Each of the plates can have a plurality of holes spaced along their lengths. A pull pin 132 can be installed through aligned holes in the plates 128, 130, depending on the position in which second portion 86 is fixedly mounted to first portion 84.

As shown in FIG. 2B, second portion 86 is angled forwardly relative to first portion 84 by about 30°, and is fixedly secured there by bolts 110 and nuts 112 passing through, for example, a second set of bolt holes in flange 114 and rib 90. Wedge shaped spacers 140 can be interposed between flange 114 and rib 90 for a secure bolted connection.

As shown in FIG. 2C, second portion 86 is angled forwardly relative to first portion 84 by about 90°, and is fixedly secured there by bolts 110 and nuts 112 passing through, for example, a third set of bolt holes in flange 114 and rib 90. Right angle or cube shaped spacers 142 can be interposed between flange 114 and rib 90 to make the bolted connection.

If desired, wing 80 need not included a portion mounted for movement along the blade 40 to and between retracted and extended positions. In that case, wing 80 would include only portion 86 mounted in fixed relation relative to the blade 40, in multiple different positions.

Thus, no hinge mechanism is utilized to mount the second portion 86 of the wing 80 to first portion 84 of the wing 80 in FIGS. 1A-C. Rather, second portion 86 is mountable to first portion 84 in fixed relation thereto in each of three different relative positions, 0°, 30°, and 90°. Eliminating the hinge eliminates its inherent reliability problems from the plow assembly. It also eliminates the need for a hydraulic cylinder to adjust the angle of the wing, thereby eliminating its reliability problems as well as reducing the cost of the plow assembly and reducing its weight.

Referring now to FIG. 4, and with like numbers representing like elements, first portion 84 of wing 80 is mounted for rolling movement along blade 40. For example, blade 40 can include a series of rollers 150 mounted on axles 152 supported from tabs 154 pressed out of blade 40. Second portion 86 of wing 80 can be mounted to the first portion 84 at an angle relative thereto. Second portion 86 can be mounted in fixed relation to first portion 84 as discussed above in connection with FIGS. 2A-C. Alternatively, second portion 86 can be mounted for rotating movement relative to the first portion 84 of the wing 80 via, for example, a hinge 160 as shown in FIG. 5. An actuator, for example a hydraulic cylinder, can be included for moving the second portion 86 of the wing 80 relative to the first portion 84 of the wing 80.

If desired, no second portion 86 of wing 80 need be included in the plow assembly. In that case, wing 80 would include only portion 84 mounted for rolling movement along blade 40 to and between retracted and extended positions.

Thus, no slide mechanism is utilized to mount the first portion 84 of the wing 80 to the blade 40 in FIGS. 4 and 5. Rather, first portion 84 is mounted for rolling movement along blade 40 to and between retracted positions and extended positions. Eliminating the slide mechanism eliminates its inherent reliability problems from the plow assembly.

While hinge 160 for mounting second portion 86 of wing 80 to first portion 84 of wing 80 for relative rotating movement therebetween has been described as being used in conjunction with rollers 152 for mounting first portion 84 of wing 80 for rolling movement relative to blade 40, hinge 160 could also be used in conjunction with the embodiment of FIGS. 1, 1A, 1B, 2A-C, and 3, that is to say the embodiment without rollers 152.

Referring now to FIGS. 6-8, there are shown three types of plow assemblies with which the plow wings of the present invention can be used. FIG. 6 illustrates a plow assembly 200 having a single plow blade 202, sometimes referred to as a "straight blade." Thus, plow assembly 200 is sometimes referred to as a "straight plow."

FIG. 7 illustrates a plow assembly 300 having what is sometimes referred to as a "V-blade" 302. Thus, plow assembly 300 is sometimes referred to as a "V-plow." V-blade 302 includes plow blade portions 304, 306 hinged together at a common hinge 308. The hinged blade portions 304, 306 can both be swept backwardly toward the plow vehicle, can both be swept forwardly in the direction of the plow vehicle travel, or one can be sept backwardly and the other swept forwardly, depending on the snow conditions, terrain, type of plowing operation being performed, etc.

FIG. 8 illustrates a plow assembly 400 having what is also sometimes referred to as a "V-blade" 402. Thus, plow assembly 400 is also sometimes referred to as a "V-plow." V-blade 402 includes plow blade portions 404, 406, each of which includes its own hinge 408, 410, respectively. The plow assembly 400 of FIG. 8 has the same general functional capabilities as the plow assembly 300 of FIG. 7, while reducing some of the "interference" issues caused by the blades 304, 306 pivoting about a common pivot axis 308.

The plow and blade in FIG. 8 are sometimes referred to as a "double hinge V-plow" and "double hinge V-blade," respectively, while the plow and blade in FIG. 7 are sometimes referred to as a "single hinge V-plow" and "single hinge V-blade."

Referring now to FIGS. 9, 10A and 10B, a plow wing assembly 500 is shown mounted to straight blade 202, single hinge V-blade 302, or double hinge V-blade 402. Plow wing assembly 500 includes a first portion 502 and a second portion 504. First portion 502 is be mounted to the blade 202, 302, or 402 for translational movement relative thereto. Second portion 504 is mounted to the first portion 502 for rotational movement relative thereto. More particularly, first portion 502 can include a plurality of rollers 506 mounted thereto providing rolling movement of the first portion 502 relative to the blade 202, 302, or 402. As shown in FIG. 10A, a hinge 508 can provide pivoting movement of the first portion 504 relative to the first portion 502.

An actuator, for example a hydraulic actuator, has a cylinder 510 and first and second oppositely movable piston rods 512, 514, respectively. The first piston rod 512 and the cylinder 510 are operable to move the first portion 502 of the wing 500 relative to the blade 202, 302, or 402, and the second piston rod 514 and the cylinder 510 are operable to move the second portion 504 of the wing 500 relative to the first portion 502 of the wing 500. For example, first piston rod 512 can be secured to rib 54 of blade 202, 302, or 402, cylinder 510 can be secured to rib 52 of wing first portion 502, and second piston rod 514 can be secured to rib 92 of wing second portion 504, to provide the described movements. More specifically, with respect to the pivoting movement of wing second portion 504 relative to wing first portion 502, a dog leg link 516 can have one end pivoted to second piston rod 514 with a pin 520 and the other end pivoted to a clevis 522 with a pin 524. Clevis 522 slides in a slot 526 formed in a plate 528 secured to wing second portion 504, to provide the described pivoting movement.

FIG. 11 illustrates the plow wing 500 slidably mounted relative to the blade 202, 302, 402, rather than mounted for rolling movement, as illustrated in 9, 10A and 10B.

FIG. 12 illustrates the plow wing second portion 504 mounted in fixed relation relative to the first portion 502, albeit in multiple different positions, as discussed-above in connection with FIGS. 1B, 2A-C, and 3.

The embodiments of the invention shown and described are merely for illustrative purposes only. The drawings and the description are not intended to limit in any way the scope of the invention as defined in the claims. Furthermore, those skilled in the art will readily recognize various changes to, and additional embodiments of, the invention, all of which will fall within the spirit and scope of the invention as defined in the claims. For example, while the invention has been shown and described in the context of straight blade plows, the invention can also be practiced with V-plows. And, while the invention has been shown and described in the context of plowing snow, the invention can also be practiced with other plowable materials. Further, while the invention has been shown and described in the context of being attached to the front of a vehicle and being pushed, the invention can also be practiced by being attached to the rear of the vehicle and being pulled. Yet further, while the invention has been shown and described as being attached to pickups, SUV's, and skid steers, the invention can be practiced by being attached to other vehicles. Accordingly, the invention is to be limited only by the scope of the following claims and their equivalents.

I claim:

1. A plow assembly comprising:

a blade, structure attached to said blade and adapted to be attached to a vehicle for mounting said blade to and supporting said blade from the vehicle, and a wing attached to an end of said blade, said wing having a first snow engaging portion mounted to said blade for translational movement relative to said blade, and a second snow engaging portion mounted to said first portion for rotational movement relative to said first portion, and an actuator having a cylinder and first and second oppositely movable piston rods, said first piston rod and said cylinder operable to move said first portion of said wing relative to said blade, said second piston rod and said cylinder operable to move said second portion of said wing relative to said first portion of said wing, said cylinder mounted to said first snow engaging portion of said wing, said first piston rod attached to said blade, said second piston rod pivotally attached to one end of a link, the other end of said link pivotally and slidably attached to said second snow engaging portion of said wing, wherein said link is a dog leg link, said other end of said link is pivotally attached to a clevis for pivoting about a pivot axis, and said clevis is mounted for sliding movement in a slot in a plate attached to said second snow engaging portion of said wing, said pivot axis being generally parallel to a plane defined by a width and a length of said slot.

2. The plow assembly of claim 1 wherein said blade is a straight blade.

3. The plow assembly of claim 1 wherein said blade is a single hinge V-blade.

4. The plow assembly of claim 1 wherein said blade is a double hinge V-blade.

5. The plow assembly of claim 1 wherein said first portion of said wing is mounted for rolling movement relative to said blade.

6. The plow assembly of claim 5 further including a plurality of rollers mounted to said blade providing the relative rolling movement.

7. The plow assembly of claim 5 further including a plurality of rollers mounted to said first portion of said wing providing the relative rolling movement.

8. The plow assembly of claim 1 wherein said first portion of said wing is mounted for sliding movement relative to said blade.

9. A blade assembly for a plow assembly comprising:

a blade adapted to be mounted to and supported from a vehicle, a wing attached to an end of said blade, said wing having a first snow engaging portion mounted to said blade for translational movement relative to said blade, and a second snow engaging portion mounted to said first portion for rotational movement relative to said first portion, and an actuator having a cylinder and first and second oppositely movable piston rods, said first piston rod and said cylinder operable to move said first portion of said wing relative to said blade, said second piston rod and said cylinder operable to move said second portion of said wing relative to said first portion of said wing, said cylinder mounted to said first snow engaging portion of said wing, said first piston rod attached to said blade, said second piston rod pivotally attached to one end of a link, the other end of said link pivotally and slidably attached to said second snow engaging portion of said wing, wherein said link is a dog leg link, said other end of said link is pivotally attached to a clevis for pivoting a bout a pivot axis, and said clevis is mounted for sliding movement in a slot in a plate attached to said second snow engaging portion of said wing, said pivot axis being generally parallel to a plane defined by a width and a length of said slot.

10. The blade assembly of claim 9 wherein said blade is a straight blade.

11. The blade assembly of claim 9 wherein said blade is a single hinge V-blade.

12. The blade assembly of claim 9 wherein said blade is a double hinge V-blade.

13. The blade assembly of claim 9 wherein said first portion of said wing is mounted for rolling movement relative to said blade.

14. The blade assembly of claim 13 further including a plurality of rollers mounted to said blade providing the relative rolling movement.

15. The blade assembly of claim 13 further including a plurality of rollers mounted to said first portion of said wing providing the relative rolling movement.

16. The blade assembly of claim 9 wherein said first portion of said wing is mounted for sliding movement relative to said blade.

* * * * *

UNITED STATES PATENT AND TRADEMARK OFFICE

CERTIFICATE OF CORRECTION

PATENT NO. : 7,681,337 B2
APPLICATION NO. : 11/333048
DATED : March 23, 2010
INVENTOR(S) : Gary E. Watson It is certified that error appears in the above-identified patent and that said Letters Patent is hereby corrected as shown below:

Title Page, Column 1, line 34 reads: "3,376,084 A 4/1968 Ulrich"; it should read: -- 3,378,084 A 4/1968 Ulrich --.

Title Page, Column 2, line 36 reads: "of the wing relative to the fist portion of the wing."; it should read: -- of the wing relative to the first portion of the wing. --.

Column 1, line 42 reads: "Blizard Corporation, Calumet, Mich., and all hereby incor-"; it should read -- Blizzard Corporation, Calumet, Mich., and all hereby incor- --.

Column 8, line 59, Claim 9, reads: "link is pivotally attached to a clevis for pivoting a bout a"; it should read: -- link is pivotally attached to a clevis for pivoting about a --.

Signed and Sealed this

Twenty-first Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,681,337 B2
APPLICATION NO. : 11/333048
DATED : March 23, 2010
INVENTOR(S) : Gary E. Watson It is certified that error appears in the above-identified patent and that said Letters Patent is hereby corrected as shown below:

Title Page, Item (73) reads: "Assignee: Batesville Casket Company, Inc., Batesville, IN"; it should read -- (73) Assignee: Douglas Dynamics, L.L.C. --.

Signed and Sealed this
Twelfth Day of April, 2011

David J. Kappos

David J. Kappos
*Director of the United States Patent and Trademark Office*